United States Patent [19]

Miller et al.

[11] 3,995,731

[45] Dec. 7, 1976

[54] MULTI-RIBBON CASSETTE AND RIBBON DRIVE

[75] Inventors: Harry R. Miller, Trumansburg; Michael S. Kumpf, Dryden, both of N.Y.

[73] Assignee: NCR Corporation, Dayton, Ohio

[22] Filed: June 2, 1975

[21] Appl. No.: 580,265

[52] U.S. Cl. ..... 197/168; 197/151

[51] Int. Cl.[2] ..... B41J 33/10; B41J 33/04

[58] Field of Search ..... 197/1 R, 151, 156, 168; 101/336

[56] References Cited

UNITED STATES PATENTS

| | | | |
|---|---|---|---|
| 553,909 | 2/1896 | Heath et al. | 197/21 |
| 3,311,316 | 3/1967 | Williams | 197/168 UX |
| 3,532,204 | 10/1970 | Sasaki | 197/82 X |
| 3,695,410 | 10/1972 | Kapp | 197/156 UX |
| 3,726,212 | 4/1973 | Combs | 197/156 X |
| 3,758,012 | 9/1973 | Bonner et al. | 197/151 UX |
| 3,871,507 | 3/1975 | Perry et al. | 197/168 X |
| 3,904,017 | 9/1975 | Frechette | 197/170 X |

*Primary Examiner*—Edgar S. Burr
*Assistant Examiner*—Paul T. Sewell
*Attorney, Agent, or Firm*—J. T. Cavender; Wilbert Hawk, Jr.; George J. Muckenthaler

[57] ABSTRACT

A cassette contains a pair of endless printing ribbons on separate spools, each ribbon having an independent drive with a mechanism provided to enable shifting from one drive to the other, thereby permitting selection of one or the other ribbon.

10 Claims, 14 Drawing Figures

MULTI-RIBBON CASSETTE AND RIBBON DRIVE

BACKGROUND OF THE INVENTION

In the printing field, it has been common practice to provide a ribbon in a path between the type elements and the platen, the manner and form of so doing depending upon the particular application. For example, in a typewriter there are normally two spools, one being a supply spool and the other a take-up spool with means for reversing the direction of ribbon travel so as to obtain optimum utilization of the ribbon. The ribbon also may contain both red and black ink portions and means is provided on the machine for selection of the desired color of printing. In other types of business machines, such as printers, a first drum may carry the supply of ribbon and a second drum may operate to take up the ribbon, again the apparatus being provided with reversing means for longer ribbon life. More recently, ribbons have been enclosed in a single cartridge which is readily inserted into and removed from the business machine, one type of such cartridge having a pair of spools for supply and take-up of the ribbon, and another being of the "stuffing" type wherein the ribbon is drawn from such cartridge upon operation of the machine.

In the case of a typewriter, a pre-inked ribbon is normally provided therefor and, upon extended usage thereof, is replaced with a new ribbon. In certain other types of business machines, the ribbon may or may not be pre-inked and inking or re-inking means in the form of an inking roller or a reservoir of ink is provided to extend the life of the ribbon.

An example of related prior art includes U.S. Pat. No. 3,595,362 to W. H. Wolowitz which shows a typewriter backspace and ribbon-field control for a type element with means for adjusting the vertical throw of the ribbon vibrator on the carrier, regardless of carrier movement, to select the color or kind of printing impression.

Another example of related prior art is U.S. Pat. No. 3,621,968 to N. Kondur, Jr. which discloses an inking ribbon cartridge and a ribbon in the form of an endless belt therein for transport about several parallel aligned rollers, arranged in a mobius loop configuration, and driven by means of a drive roller coupled to the roller from the printing machine.

Another example of such art is U.S. Pat. No. 3,804,227 to S. D. Cappotto el al. which shows a cartridge for housing a supply of ribbon on one spool and a friction roller cooperating with a drive roller to pull the ribbon from the supply spool through an outstretched arm and feed it back into cartridge where it is wound upon a take-up spool. A pair of geared rollers are provided for regulating the tautness of the ribbon pulled from the supply roll. One geared roller is rotated by the ribbon entering into the take-up spool and rotation of this roller drives the other geared roller adjacent the supply spool.

And, a further example of such art is U.S. Pat. No. 3,814,231 to S. D. Cappotto which discloses a stuffed ribbon cartridge for an endless loop of ribbon and feed mechanism including a gear and roller for pulling a strand of the ribbon from an outstretched arm and for stuffing a strand into the storage area of the cartridge.

SUMMARY OF THE INVENTION

The present invention relates to printing ribbons and more particularly to a pair of printing ribbons contained in a cassette for providing a single package of multi-color ribbon for a printing operation. Each of the ribbons is formed in an endless loop of the mobius type and at least one coil for each ribbon is wound around a spindle or spool, the ribbon having a rewind wrap being directed in a path on the outside of the coil or coils of ribbon and the unwind wrap being directed and pulled from a path on the inside of the coil or coils of ribbon. Each ribbon, on being unwound from its spindle, is trained or guided to a different attitude or elevation from that of the spindle and around guide means past a printing station and is then trained past drive means and back to the attitude or elevation of the spindle and thence wound thereon.

Each ribbon may be formed in at least one coil around its spindle or it may take the form of a plurality of coils depending upon the particular application. Additionally, an inking roller may be provided along the path of each ribbon to prolong the life thereof.

The two endless ribbons, one of red and the other black ink, for example, are wound on separate spools within the cassette, the red ribbon being above or in front of the black ribbon and each having its own drive independent of the other. While a preferred embodiment of the invention utilizes a red and a black ribbon, it is, of course, understandable that the two endless ribbons could contain black ink, in effect, for the purpose of doubling the capacity or life of the cassette. The drive means for the ribbons is accomplished by a pair of feed gears or wheels and pressure arms biasing rollers against the wheels, each of the feed gears or wheels having a separate driving area therein, such area being formed to receive a beveled portion of a drive shaft to provide for shifting from one ribbon drive wheel to the other without jamming the drive shaft against the drive area of the wheels. Shifting of the drive mechanism from one color ribbon to the other is accomplished by moving the cassette back and forth along a horizontal plane and the mechanism for so doing includes solenoid actuated bellcranks, and cam and follower devices.

The ribbon cassette is caused to be moved in a side-to-side direction by reason of its being connected with the print head through the ribbon shaft journaled therein, the ribbon shaft being driven by means of a cord or cable attached to the machine and wrapped around a drum or pulley which contains a one-way clutch for driving the ribbon in one direction. When the print head is caused to be traversed across the machine, the drive pulley rolls along the cord or cable and is rotated thereby, the drive shaft being connected with the pulley also is rotated to turn the ribbon drive wheel and thereby drive the ribbon in a path from the cassette past the print station and back to the cassette.

The invention also includes modifications of the ribbon drive shaft and of the drive wheels to permit variations in the driving of the two ribbons. A take-up spring is also included to maintain tension in each ribbon and remove excessive slack in the ribbon to prevent tracking thereof during printing operations.

In view of the above discussion, the principal object of the present invention is to provide a multiribbon cassette for enclosing and carrying ribbons for printing operations.

Another object of the present invention is to provide a pair of spools in a cassette for carrying one and another color endless ribbons.

An additional object of the present invention is to provide a ribbon cassette having a pair of endless ribbons which can be shifted from one to another plane for printing a different color.

A further object of the invention is to provide a ribbon cassette for a red and a black endless ribbon with means for shifting each ribbon for printing operations and means for driving the ribbons, all without jamming the drive means during shifting of the ribbons.

Additional advantages and features of the present invention will become apparent and fully understood from a reading of the following specification taken together with the annexed drawing, in which.

Figure 6:
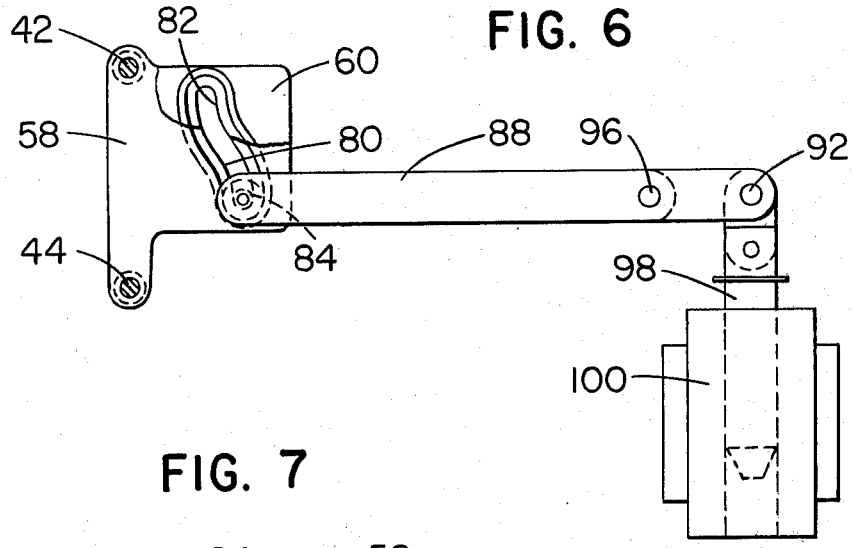
FIG. 6 is a view of the cassette actuating means in position for printing one color.
Figure 7:
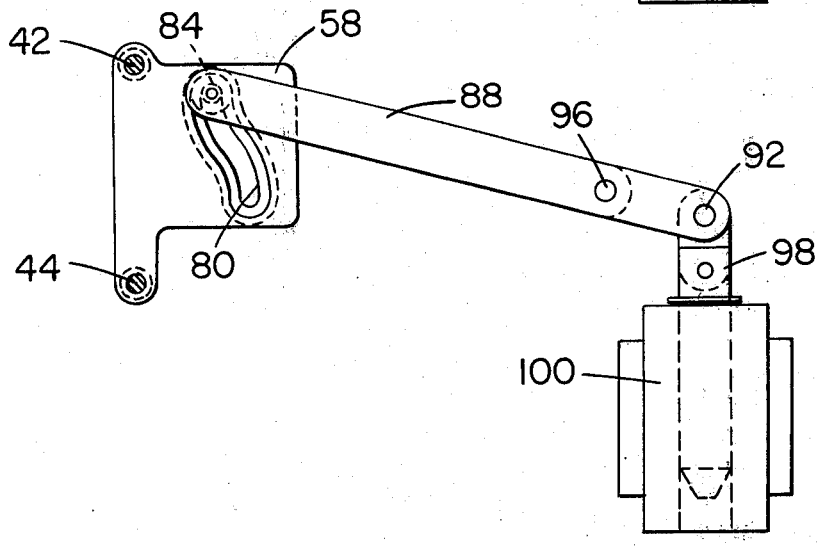
FIG. 7 is a view of the cassette actuating means in position for printing another color.
Figure 11:
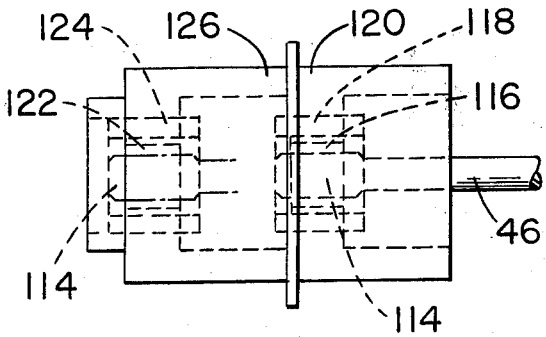
Figure 12:
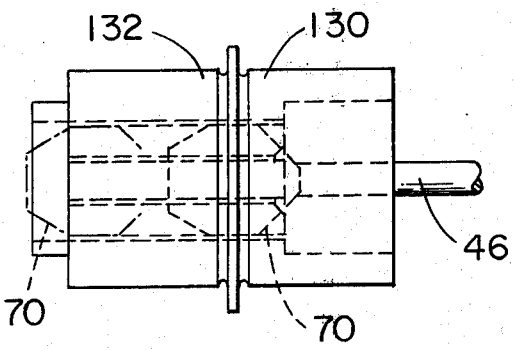

FIG. 11, on the sheet with FIGS. 6 and 7, is an enlarged view of a modification of the ribbon drive means; and FIG. 12, on the sheet with FIGS. 6 and 7, is an enlarged view of a further modification of the ribbon drive means.

Figure 1:
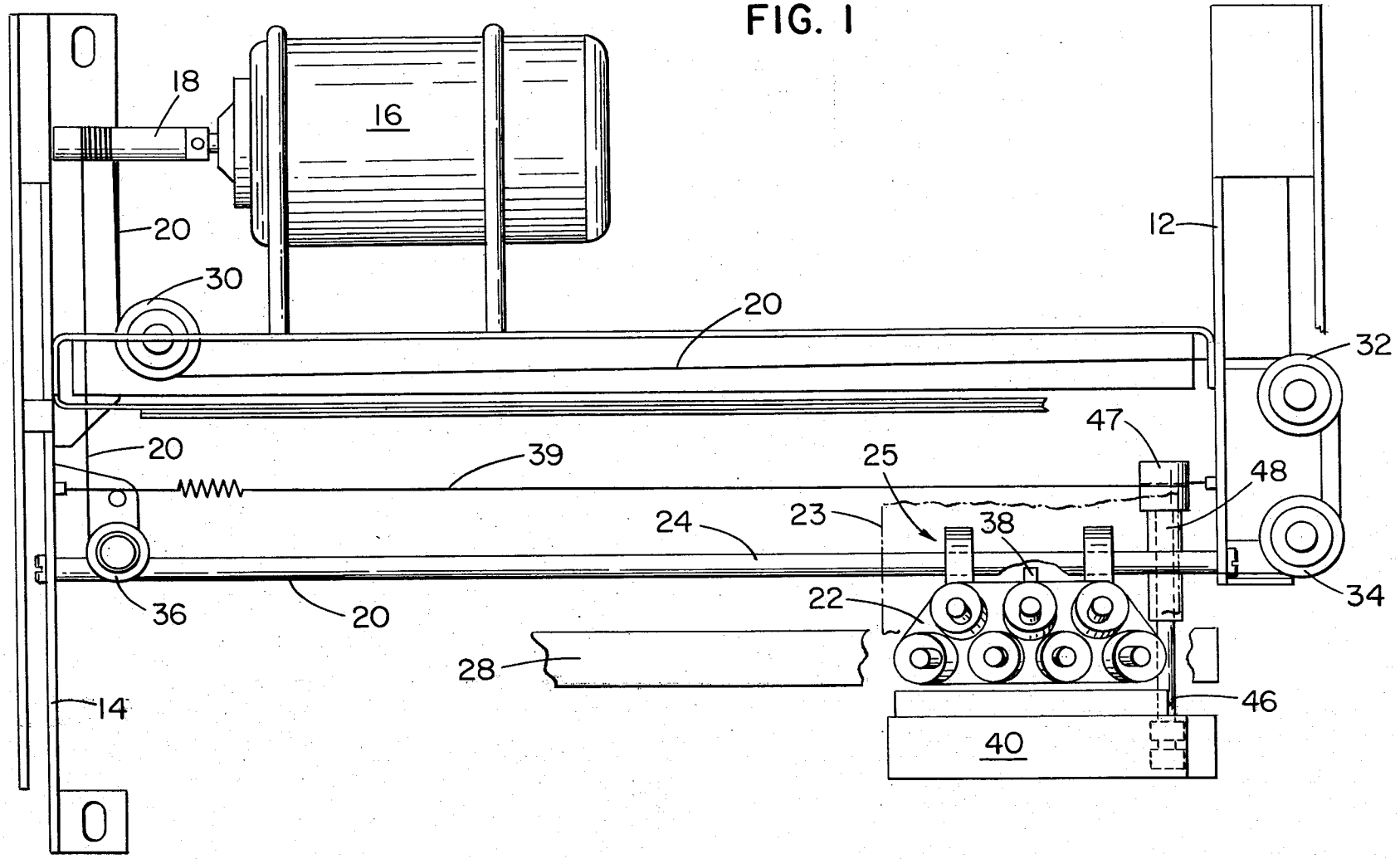
FIG. 1 is a top plan view in limited illustration of printing apparatus incorporating the subject matter of the present invention.
Figure 2:
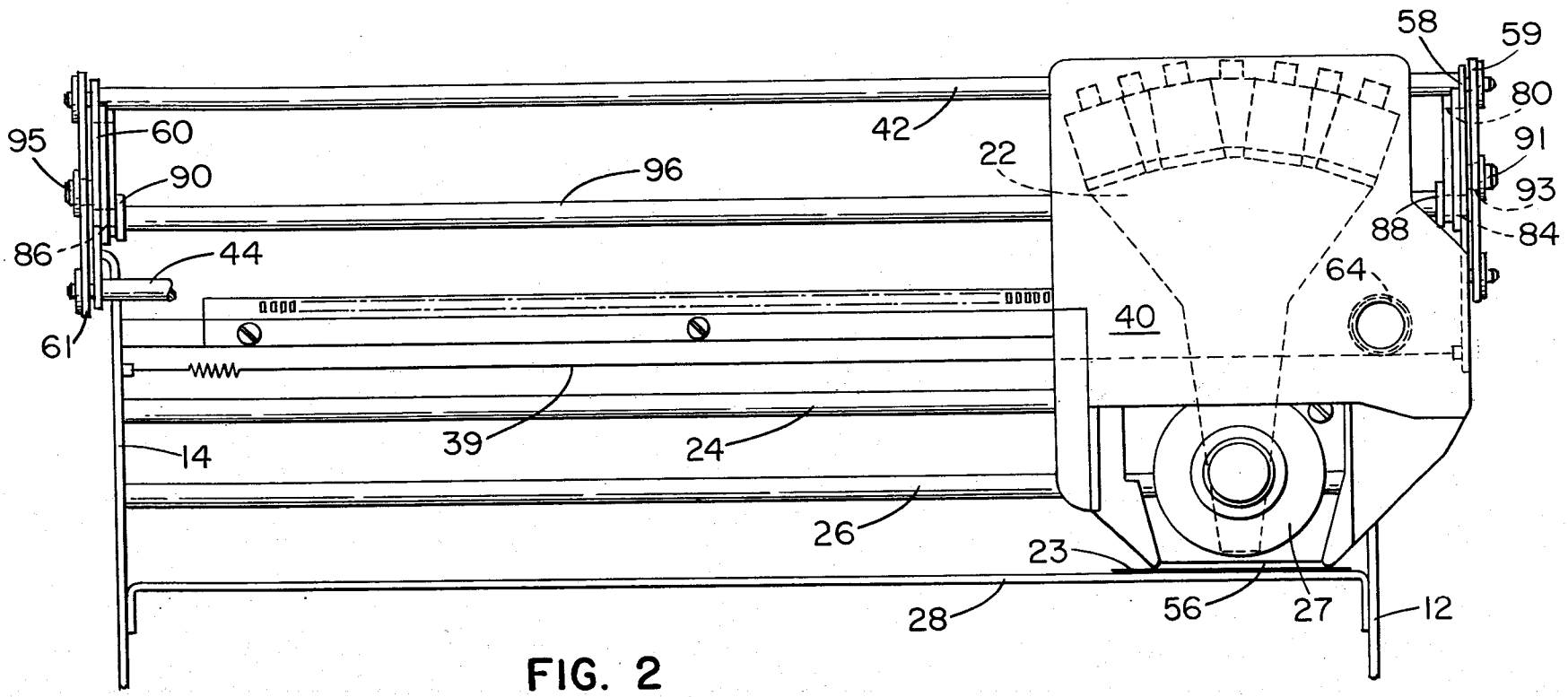
FIG. 2 is a front elevational view of the apparatus shown in FIG. 1.

Referring now to FIGS. 1 and 2, there is shown, in limited illustration, a printer which incorporates the subject matter of the present invention, wherein side frame members 12 and 14 are positioned to provide space and supports for operating members of the machine. A reversing type motor 16 is supported at the rear left side of the printer and has a shaft 18 rotatable to drive a cord or belt 20, which cord is utilized to drive a print head 22 back and forth in transverse manner across the printer. While the present invention may be particularly applicable to form or passbook printing, there may be one or more print stations positoned across the machine for the purpose of printing on record media 23 such as a receipt, a journal, and a slip or form. The receipt print station may be located at the right side, with the journal print station in the center, and the slip or form print station at the left side. In some machines, a receipt station and a journal station are desired, in others a receipt station, and in still others only a slip or form station. In the present machine, which may be for such passbook type transactions as alluded to above, the print station may extend substantially the width of the machine for printing the desired information in a customers passbook for chronologically maintaining a record of the transactions.

Figure 4:
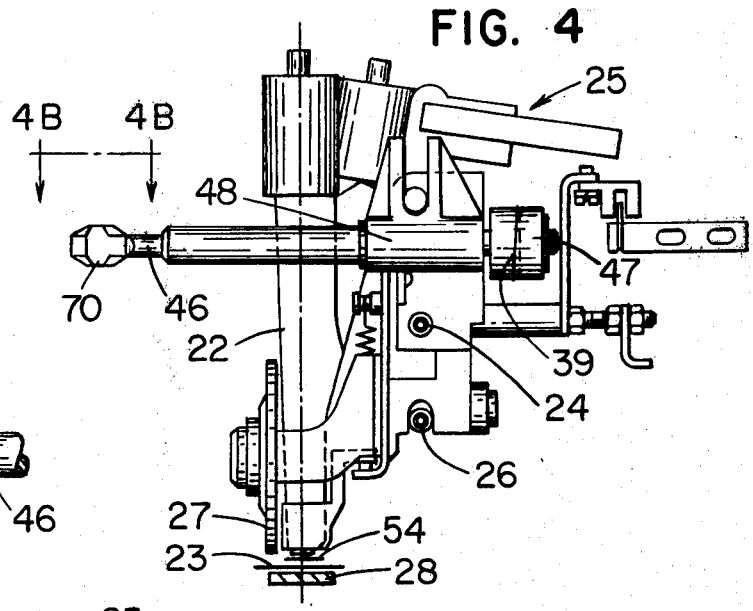
FIG. 4 is a side elevational view showing in more detail the drive means for the ribbons.
Figure 4A:
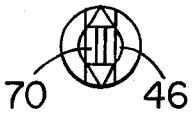
FIG. 4A is an end view of the ribbon drive shaft.
Figure 4B:
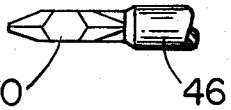
FIG. 4B is a view of the driving portion of the shaft taken on the plane 4B—4B of FIG. 4.
Figure 5:
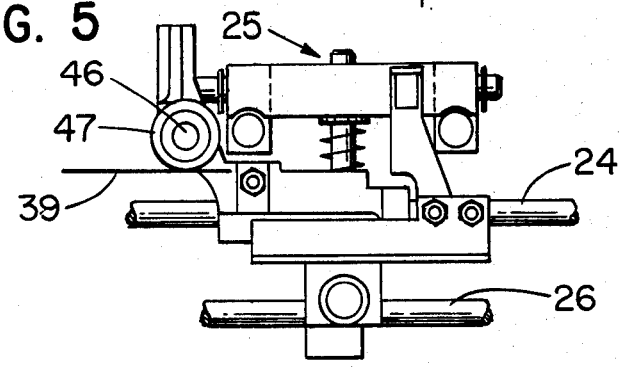
FIG. 5 is a rear view of the print head carriage and the drive pulley for the ribbons.

The frame members 12 and 14 are connected together by suitable straps, bars, and the like together with shafts or guide rods 24 and 26 for carrying the print head 22 and its associated carriage mechanism 25 (see FIGS. 3, 4, and 5) in back-and-forth travel across the machine. Such shafts or guide rods 24 and 26 are spaced to carry the print head 22 in a precise path in relation to a platen 28 over which the ribbon and record media are moved during the printing operations. While printing is normally accomplished during one direction of travel of the print head 22, with nonprinting in a return direction, printing may also be performed in both directions of print head travel. In the present invention, printing is performed in a right to left direction of the print head 22 with the ribbon traveling or being driven in a counterclockwise direction of rotation while printing, and the ribbon being idle and therefor not being driven under nonprinting conditions. The carriage mechanism 25 also carries a forms compensation wheel 27 (FIGS. 2 and 4) engageable with the record media 23 to maintain a precise distance between the print head 22 and the media 23.

The drive cord 20 is wrapped around the motor shaft 18 for a certain number of turns and is trained around a pulley 30, rightward to and around a pulley 32, forward and around a pulley 34, leftward and around a pulley 36, and back to the motor shaft 18. The cord 20 is intersected and secured to the print head 22 at an attaching point 38 (FIG. 1) to drive the head in its side-to-side travel.

A cord 39 is utilized to drive the inking ribbons which are contained in a cassette 40 which is carried on shafts or guide rods 42 and 44 by means of clips 43 and 45 secured to the cassette 40 and formed to retain the cassette 40 on the rods 42 and 44 in the travel of the cassette 40 across the machine along with the print head 22. The clips 43 and 45 also permit easy removal of the cassette 40 for replacement thereof or for field maintenance of associated parts. The cassette 40 contains a pair of endless ribbons which, for purposes of the present disclosure, has one ribbon impregnated with black ink and the other impregnated with red ink. Drive means for the ribbons is accomplished by a shaft 46 having a pulley 47 at the rear end thereof (FIG. 3, 4, 5, and 10), the cord 39 encircling the pulley and rotating same in a counterclockwise direction, as viewed from the front of the machine, whenever the cord 20 is driven to propel or move the print head 22 in its printing direction of travel across the print station. The shaft 46 is carried by a bearing portion 48 of the print head carriage mechanism 25 and extends forwardly thereof to engage with ribbon drive wheels in the cassette 40.

Figure 8:
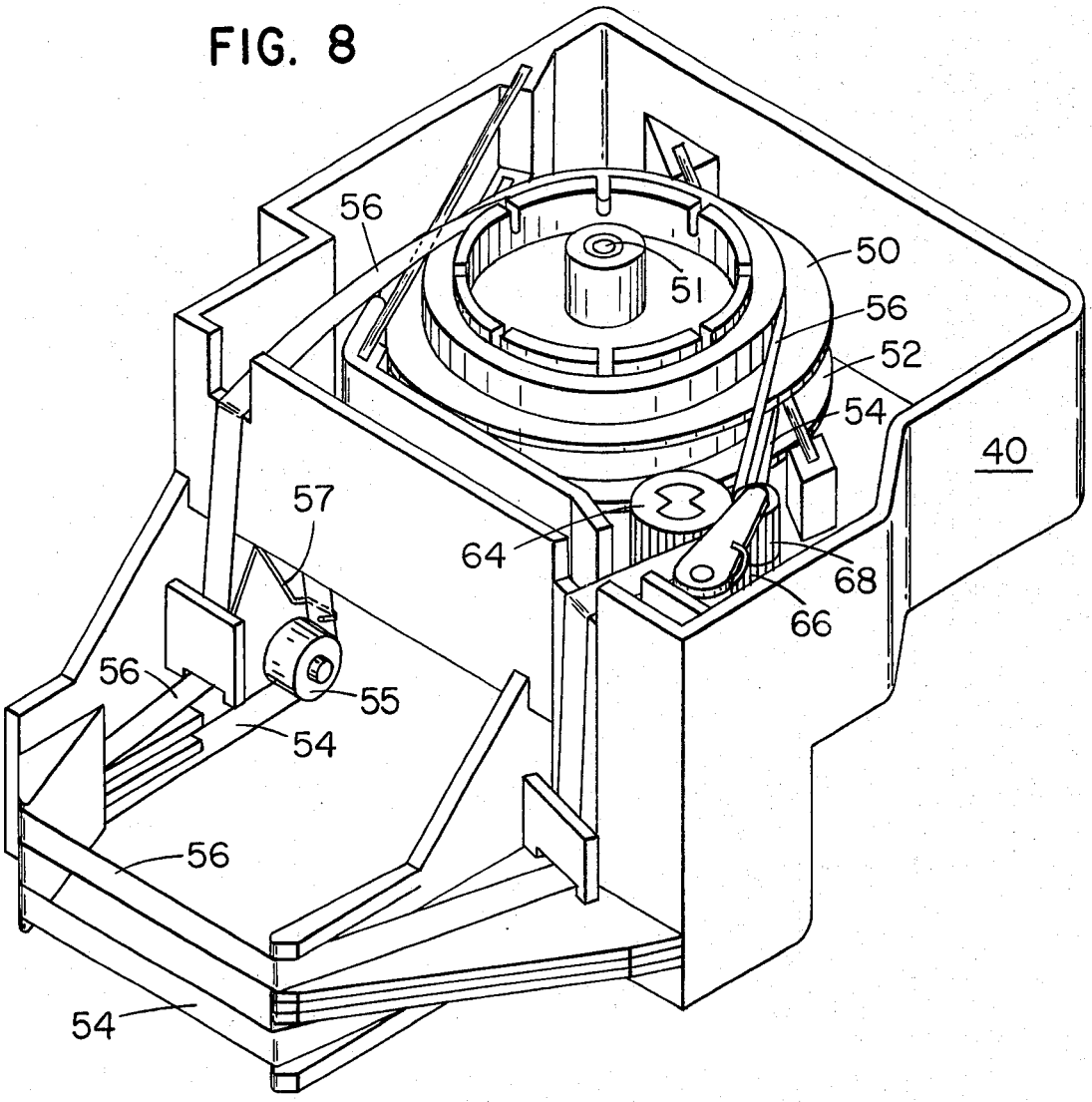
FIG. 8 is a perspective view of the multi-ribbon cassette.
Figure 9:
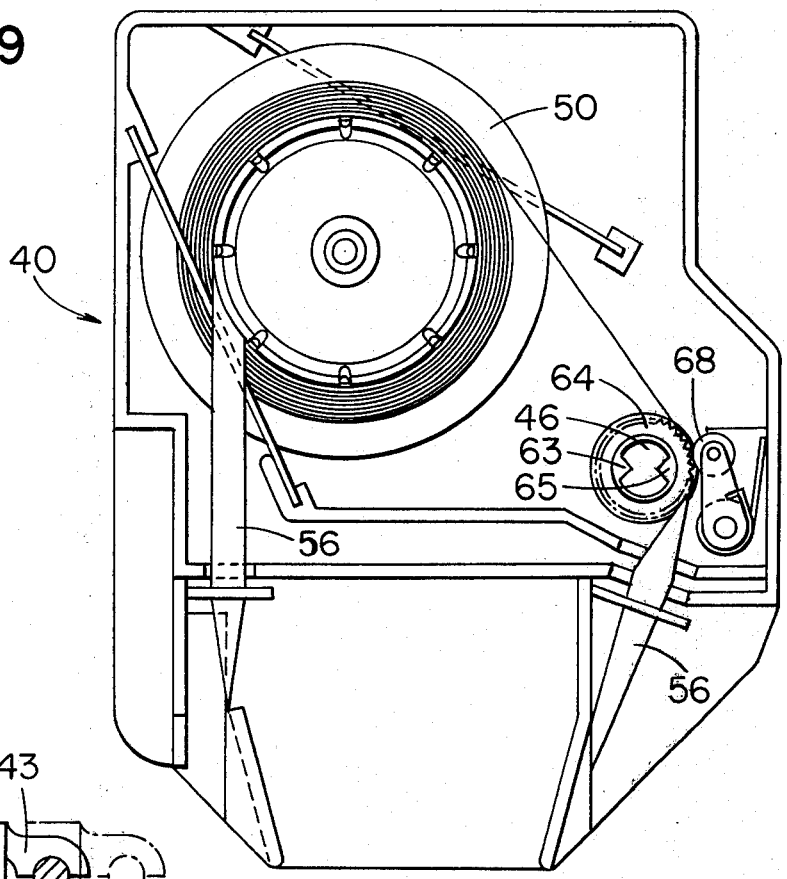
FIG. 9 is a front view of the cassette showing the path of the ribbons.

The cassette 40 includes a pair of spools 50 and 52 (FIG. 8) stacked on a shaft 51 and constructed to be independently rotatable to provide either a black ribbon 54 or a red ribbon 56 for the printing operation. Each of the ribbons 54, 56 may be of the mobius type wherein the ribbon is unwrapped from the inside of a coil of ribbon (FIG. 9), is directed to a different level or attitude past the printing station, and is then directed back to the spool level where the ribbon is wrapped on the outside of the coil of ribbon. Each of the spools 50, 52 may contain an ink supply in the form of a re-inker whereby the ribbons 54, 56 are continuously inked for the printing operations. Suffice it to say that various ways and means could be utilized to provide ink to the endless ribbons 54, 56 in a cassette of the described type, one of these ways being an ink roller, as at 55 (FIG. 8). Additionally, since many of the ribbon cassettes are of the "throw-away" type, such cassettes are used for the life of the ink in the ribbon and do not include means for re-inking thereof. The cassette 40 includes various guide means for directing the ribbons 54, 56 in their path, in addition to spring means 57 or the like for maintaining proper tension in the ribbons and for taking up any slack therein during printing operations.

The cassette 40 is supported independently from the print head 22 by means of a pair of camming plates 58 and 60 carried on support members 59 and 61, although the cassette 40 is carried by the guide bars or shafts 42 and 44 in the travel of the cassette 40 across the machine. It is thus seen that the drive shaft 46 is rotatably driven to advance the ribbons 54, 56 in one direction and such shaft 46 also serves a second purpose of moving the cassette 40 in its back-and-forth travel with the print head 22, that is, when the print head 22 is caused to be moved across the machine by the cord 20, the shaft 46, by reason of its being journaled in the print head carriage 25 and extending to the drive wheels in the cassette 40 carries or transports the cassette 40 along with the print head 22 in the transverse travel thereof.

The ribbon drive wheels 62 and 64 are made a part of the cassette 40 and are journaled in axial alignment on the right hand side thereof to be engageable with the respective ribbons 54, 56 for driving thereof during the printing operation. Each of the drive wheels 62 and 64 has a spring loaded idler or pressure wheel adjacent thereto (FIGS. 8 and 9), with a wheel 66 for the drive wheel 62 and a wheel 68 for the drive wheel 64 to provide proper drive for the respective ribbons 54, 56.

Figure 3:
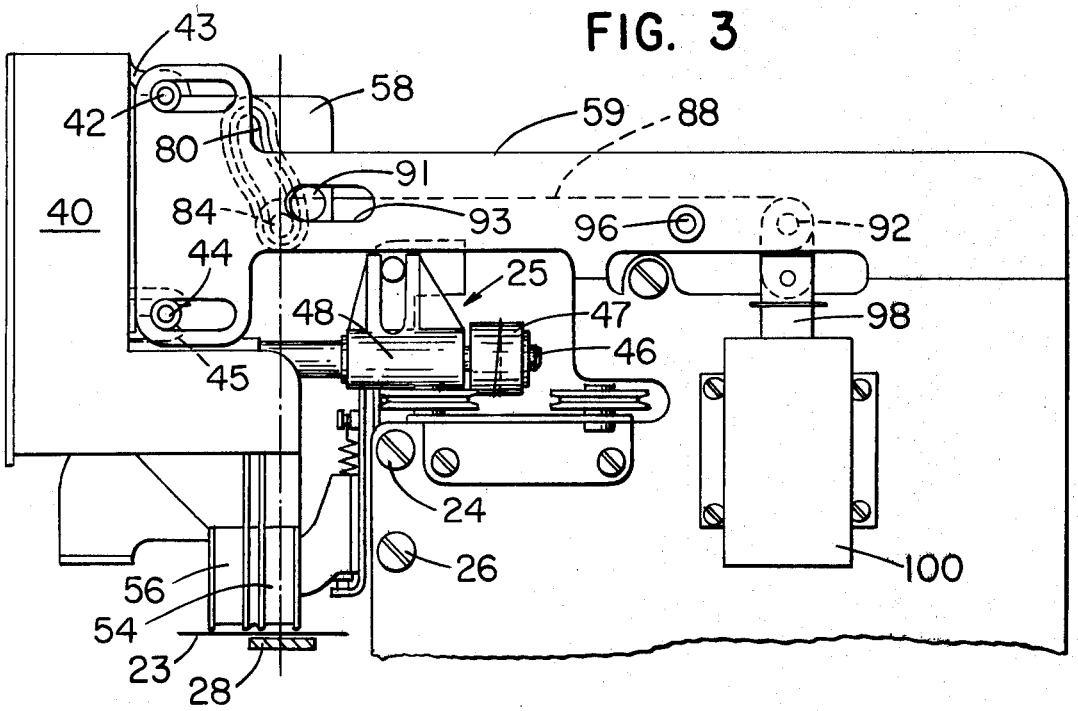
FIG. 3 is a right side elevational view of the apparatus shown in FIG. 2.

Referring back to the description of the spools 50 and 52 for supporting the ribbons 54 and 56 in the cassette 40, the black ribbon 54 is carried on the rearward spool 52 and the red ribbon 56 is carried on the forward spool 50 to effect the position of the black ribbon 54 for operating with the print head in one position of the cassette 40, it being seen that in a forward position of such cassette 40 the black ribbon 54 is in a path with the print head 22 and in the line of print for black printing (FIG. 3). In this position of the cassette 40, the drive shaft 46 has a forward end portion 70 which is constructed in a unique manner to mate with and engage with the drive wheel 62 for driving thereof when the print head 22 and cassette 40 are caused to be moved across the machine. Each of the drive wheels 62 and 64 include triangular shaped interior projections or abutments 63 and 65 (FIG. 9) for driving engagement by the end portion 70 of drive shaft 46. The end portion 70 includes fluted or beveled surfaces which provide for sliding movement within the interior of the drive wheels 62 and 64 for driving of the ribbons 54 and 56.

When it is desired to use the red ribbon 56 in a printing operation, the cassette 40 is caused to be moved rearwardly to place the red ribbon in the path of the print head 22 and thereby in the line of print (FIG. 3). The apparatus and structure for moving the cassette 40 in a rearward direction to effect printing with the red ribbon includes the camming plates 58 and 60 slidably connected with support members 59 and 61 (FIG. 2), the plates 58 and 60 having elongated curved slots or openings 80 and 82, respectively, (FIGS. 3, 6 and 7) therein for reception of pins 84 and 86 (FIG. 2) attached to the end of shift links 88 and 90, such links extending rearwardly to a pivot point 92 for link 88 and a similar pivot point (not shown) for link 90. A bail 96 extends from the one shift link 88 across the machine to the other link 90 to effect a tie therebetween. Link 88 is connected through the pin 92 to the armature 98 of a solenoid 100. As seen in FIG. 6, the forward end of the shift link 88 has its pin 84 in the lower portion of the slot 80 within camming plate 58, and the forward end of the left shift link 90 has its pin 86 in the lower portion of the slot 82. The camming plate 58 has a stud 91 (FIG. 3) slidable in a slot 93 in support member 59 and the plate 60 has a similar stud slidable in a slot, not shown, in support member 61 to permit relative movement between the plates 58, 60 and the members 59, 61. FIG. 6 shows the solenoid 100 in a de-energized condition, wherein the cassette 40 is in its forward position with respect to the print head 22 and where the black ribbon 54 is being utilized for printing.

Movement of the cassette 40 to the rearward position to effect utilization of the red ribbon 56 is initiated by energizing the solenoid 100 (FIGS. 3, 6 and 7) which causes the plunger 98 to be retracted downwardly and thereby pull the rear end portion of the shift links 88 and 90 downwardly on the pivot point 92 and the corresponding left hand pivot point, with the bail 96 secured to the links 88, 90 effectively tying the links together in any movement thereof and to cause the forward end portions of the links 88, 90 to rise in the camming slots 80 and 82, the action thereof moving the camming plates 58 and 60 along with the guide rods 42 and 44 and the cassette 40 in a rearward direction with respect to the support members 59, 61 to place the red ribbon 56 in the line of print with the print head 22. The bail 96, extending across the machine from shift link 88 to link 90, acts as the fulcrum of the lever action initiated by the plunger 98 of solenoid 100, the bail effectively maintaining the shift links in a precise path of movement when repositioning the cassette 40. When the cassette 40 is moved rearwardly, the frontal end portion 70 of drive shaft 46 is moved from engagement with ribbon drive wheel 62 and enters into engagement with ribbon drive wheel 64 (FIG. 10) to effect driving of the red ribbon 56. Since the frontal end portion 70 of shaft 46 is of a particular fluted or beveled construction, the change in engagement or shifting from one to the other ribbon drive wheel is made certain and smooth. Of course, when it is desired to again utilize the black ribbon 54, the solenoid 100 is de-energized to cause the shift links 88 and 90 to return to a horizontal condition for again shifting the camming plates 58 and 60 forwardly and thereby move the cassette 40 to the forward position wherein the black ribbon is again in the path with the line of print of the print head 22. In the particular construction of several of the various items, the ribbons 54 and 56 are ¼ inch wide and a ¼ inch movement of the solenoid plunger 98 causes the cassette 40 to be moved ½ inch in a fore-and-aft direction. As mentioned above, while it is the usual procedure to employ a black and a red ribbon in the preferred embodiment as described herein, the multi-ribbon cassette could contain two or more ribbons of the same color for increased capacity and life of the cassette.

Figure 10:
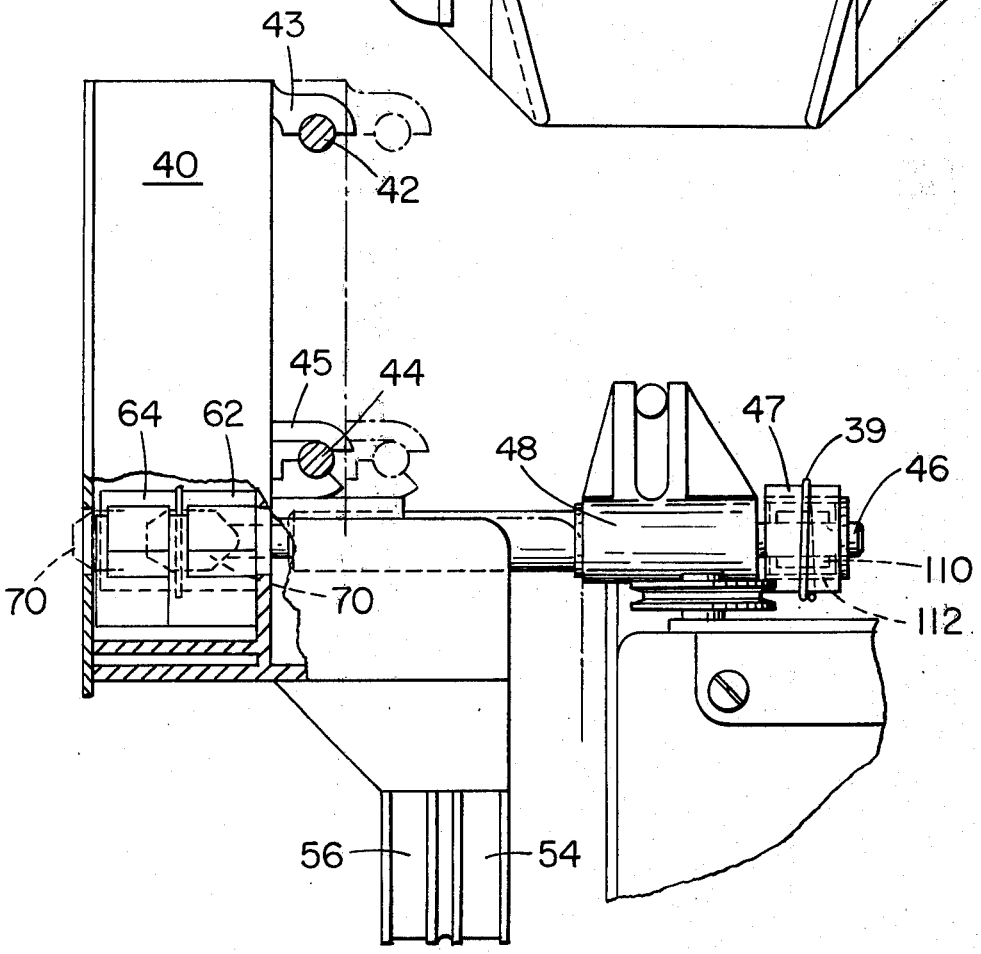
FIG. 10 is a side view of the cassette showing the relative position of the ribbon drive wheels.

As mentioned above, the ribbons 54 and 56 are caused to be advanced or driven in one direction only, this being a counterclockwise direction as viewed from the front of the machine (FIGS. 2 and 9), with such driving being accomplished by means of the cord 39 encircling the pulley 47 and rotating said pulley as the print head 22 and the cassette 40 are moved across the machine, the ribbon being driven only during the printing portion of the cycle. Pulley 47 includes a one-way clutch therein of common design for driving rotation of the pulley in one direction and permitting idle rotation thereof in the other direction. As seen in FIG. 10, a one-way clutch 110 is pressed into an insert or bushing 112 which is pressed into the pulley 47 to enable driving or non-driving rotation of the shaft 46. When the print head 22 and the cassette 40 are caused to be moved in a right-to-left direction, the ribbon is caused to be advanced or driven in such counterclockwise direction to present new ribbon area for the printing operation. Upon return travel of the print head 22 and cassette 40 in a left-to-right direction, the pulley 47 is permitted to idly rotate on the shaft 46 and the shaft 46 is not driven so the ribbon remains in a stopped or non-driven condition.

A modification in the ribbon drive means is shown in FIG. 11 wherein the frontal end portion of the shaft 46 includes a cylindrical-shaped element 114 made to fit with a pair of one-way clutches, one clutch 116 together with an insert or bushing 118 being pressed into a drive wheel 120 for the black ribbon 54, and another clutch 122 together with an insert or bushing 124 being pressed into a drive wheel 126 for the red ribbon 56. The element 114 of the frontal end portion of shaft 46 is constructed with beveled ends to engage the one-way clutches 116 and 122 upon movement of the cassette 40 to engage with the respective ribbon drive wheels 120 or 126 for driving thereof. In this manner when the cassette 40 is in the forward position, the black ribbon 54 will be driven with the red ribbon 56 remaining idle or in a stopped condition, and when the cassette 40 is in the rearward position, the red ribbon 56 will be driven with the black ribbon 54 remaining idle. The energizing and de-energizing of the solenoid 100 again appropriately moves the cassette 40 to the desired position for black or red printing.

A further modification of the ribbon drive is shown in FIG. 12 wherein ribbon drive wheels 130 and 132 are made integral or are connected together by suitable means so that rotation of shaft 46 will cause driving of both wheels 130 and 132 and thereby driving of both ribbons 54 and 56 during the printing operation. In this respect the frontal end portion 70 of shaft 46 is made to fit the interior surface of the wheels 130 and 132 and drive both wheels during driving rotation of the shaft 46 regardless of the position of the cassette 40. Again, the black ribbon 54 is being utilized when the cassette 40 is in the forward position, although the red ribbon 56 is also being driven. Upon energization of the solenoid 100, the cassette is moved rearwardly where the red ribbon 56 will be utilized, with the black ribbon 54 also being driven. In a manner of repetition, the one-way clutch 110 in pulley 47 is utilized with the several above-described ribbon drives to drive the ribbons 54 and 56 during the printing operation but permit non-driving thereof during the return portion of the cycle.

It should be understood that the two ribbons will necessarily be adjacent one another at the printing station, although the configuration within the cassette can assume different modes known in the art.

It is thus seen that herein shown and described in a multi-color ribbon cassette and drive therefor wherein the cassette is adjacent and positioned at the front of the print head, the cassette and head being propelled in a side-to-side direction across the machine and with the cassette being movable in a fore-and-aft direction to effect the positioning of a black or red ribbon. The cassette has its mounting separate from the print head mounting with the ribbon drive shaft being the connection between the two parts and providing the moving force for the cassette across the machine. The apparatus enables the accomplishment of the objects and advantages mentioned above, and while several modifications of the invention have been disclosed herein, it is obvious that other variations may occur to those skilled in the art. It is contemplated that all such variations, not departing from the spirit and scope of the invention hereof, are to be construed in accordance with the following claims.

What is claimed is:

1. A multi-ribbon cassette operably associated with a print head to be carried thereby and including a first endless ribbon arranged to be driven past said print head, a second endless ribbon adjacent said first ribbon and arranged to be driven past said print head, camming means operably connected with said cassette for positioning said cassette in a first or a second position for aligning said first or said second endless ribbon in printing relationship with said print head, axially aligned advancing means engaging each of said first and second ribbons and effective when operated for driving same, and means aligned with each of said advancing means and effective for driving one or the other thereof dependent upon the position of said cassette.

2. The cassette of claim 1 wherein said advancing means comprises a plurality of axially aligned ribbon drive wheels within said cassette and said driving means comprises a shaft carried by said print head and selectively engageable with said wheels for driving one or another thereof.

3. The cassette of claim 2 wherein one end of said shaft includes a beveled portion and each of said wheels includes a mating portion therein selectively engageable by said beveled portion for driving one or another of said ribbons.

4. The cassette of claim 2 wherein each of said wheels includes clutch means therein causing driving of one or another of said ribbons in one direction only past said print head.

5. In a printer having a print head movable in transverse manner, a multi-ribbon cassette operably associated with said print head to be carried thereby, and means for driving the ribbons past said print head comprising drive means carried by said print head, driven means including a plurality of ribbon engaging drive elements positioned within said cassette, each element effective to advance one of said ribbons when driven and each element engageable by said drive means to be driven thereby, and camming means operable to move said cassette in relation to said print head to enable engagement of said drive means with one or another of said ribbon drive elements for advancing its associated ribbon, the ribbon selected to be advanced being dependent upon the position of said cassette in relation to said print head.

6. In the printer of claim 5 wherein said drive elements are axially aligned wheels and said drive means comprises a shaft member including an end portion slidably engageable with one or another of said wheels for driving same.

7. In the printer of claim 6 wherein one end of said shaft member includes a beveled portion and each of said wheels includes a mating portion therein selectively engageable by said beveled portion for driving one or another of said ribbons.

8. In the printer of claim 6 wherein each of said wheels includes clutch means therein causing driving of one or another of said ribbons in one direction only past said print head.

9. In the printer of claim 5 including bail means positioned across said printer for travel therealong by said cassette and wherein said camming means includes a pair of plate members connected with said bail means, and means for actuating said bail means from one to another position.

10. In the printer of claim 5 wherein said camming means includes a pair of bail members operably connected with said cassette and a pair of arm members connected with said bail members and actuated to move said cassette from one to another position.

* * * * *